US007381169B2

(12) United States Patent
Pearson

(10) Patent No.: US 7,381,169 B2
(45) Date of Patent: Jun. 3, 2008

(54) ABDOMINAL MUSCLE EXERCISE APPARATUS

(76) Inventor: Jon D. Pearson, 17112 Spring Hollow Ct., Mt. Airy, MD (US) 21771

( * ) Notice: Subject to any disclaimer, the term of this patent is extended or adjusted under 35 U.S.C. 154(b) by 434 days.

(21) Appl. No.: 11/019,858

(22) Filed: Dec. 22, 2004

(65) Prior Publication Data

US 2006/0135327 A1 Jun. 22, 2006

(51) Int. Cl.
*A63B 26/00* (2006.01)
*A63B 23/00* (2006.01)
*A63B 21/065* (2006.01)

(52) U.S. Cl. ..... 482/140; 482/105; 482/148

(58) Field of Classification Search ..... 482/105, 482/140, 148, 141
See application file for complete search history.

(56) References Cited

U.S. PATENT DOCUMENTS

| | | | | |
|---|---|---|---|---|
| 3,691,140 | A | 9/1972 | Silver | |
| 3,913,569 | A * | 10/1975 | Kanonas | 601/14 |
| 4,775,148 | A | 10/1988 | Mc Laughlin | |
| 4,824,105 | A | 4/1989 | Goldenberg | |
| 4,981,147 | A * | 1/1991 | Barnett | 128/842 |
| 5,269,737 | A | 12/1993 | Sobotka | |
| 5,394,877 | A * | 3/1995 | Orr et al. | 600/459 |
| 5,492,520 | A | 2/1996 | Brown | |
| 5,823,913 | A | 10/1998 | Aruin | |
| 5,913,757 | A | 6/1999 | Winters | |
| 6,017,624 | A | 1/2000 | Delgado | |
| 6,200,195 | B1 | 3/2001 | Furuno | |
| 6,607,486 | B1 * | 8/2003 | Watson | 600/304 |
| 6,669,610 | B2 | 12/2003 | Slowinski | |
| 6,712,742 | B2 | 3/2004 | Suiter | |
| 6,758,720 | B2 | 7/2004 | Chen | |
| 6,780,081 | B2 | 8/2004 | Chen et al. | |
| 6,929,627 | B2 * | 8/2005 | Mahoney | 604/332 |
| 7,025,723 | B1 * | 4/2006 | Watson | 600/304 |
| 2004/0010311 | A1 * | 1/2004 | Reynolds et al. | 623/7 |

* cited by examiner

*Primary Examiner*—Fenn C. Mathew
(74) *Attorney, Agent, or Firm*—Thomas T. Aquilla

(57) ABSTRACT

Apparatus for exercising the abdominal muscles includes a flexible substrate that substantially conforms to a user's abdomen, with a tacky pressure-sensitive adhesive disposed on one side of the flat or contoured surface, for adhering the exercise apparatus to the user's abdomen, and a system for attaching additional weight to the apparatus for providing increased resistance. The pressure sensitive adhesive (PSA) allows the exercise apparatus to adhere to the user's abdomen, and enables releasable attachment, such that the apparatus can be attached and detached from the abdomen repeatedly, and can be reused. Optional weights are attached to the apparatus to increase resistance, as desired. While on his/her hands and knees, the user contracts the stomach muscles and pulls his/her abdomen with the attached apparatus inward toward the spine, thus exercising the abdominal muscles.

5 Claims, 8 Drawing Sheets

ABDOMINAL MUSCLE EXERCISE APPARATUS

BACKGROUND OF THE INVENTION

1. Field of the Invention

The invention pertains to the field of exercise equipment. More particularly, the invention pertains to equipment or apparatus for exercising the muscles of the stomach or abdomen, and particularly the Transverse Abdominus muscles.

2. Description of Related Art

As a result of over-eating or pregnancy, among other possible causes, the muscles of the abdomen may become stretched and weakened, allowing the abdominal wall to be distended typically resulting in a common characteristic, known colloquially as "pot belly".

There are a number of already existing devices that are intended to strengthen or exercise the muscles of the abdomen. Some such devices are intended to aid in exercising the Rectus Abdominus, which are the vertically aligned outermost muscles used, for example, in sit-ups and crunches. Examples of such devices include those described in U.S. Pat. Nos. 5,492,520, 6,712,742, and 5,913,757.

The middle two layers of abdominal muscles are referred to as the External Oblique and Internal Oblique muscles. These muscles allow the abdomen to twist and bend to the side. Examples of devices intended to aid in exercising these muscles include those that are described in U.S. Pat. Nos. 6,669,610 and 5,269,737.

The innermost abdominal muscles are referred to as the Transverse Abdominus muscles. These latter muscles wrap around the stomach and act as a girdle to prevent distention thereof. Several known devices attempt to focus exercise on these particular muscles, but these known devices either offer no substantial resistance to contracting or pulling the stomach in toward the spine, such as, for example, the device described by U.S. Pat. No. 5,823,913, or fail to provide substantial resistance in the opposite direction (e.g., extending or pushing the stomach outwardly away from the spine), such as those devices described in U.S. Pat. Nos. 4,775,148 and 4,824,105.

One of the preferred exercises used extensively by post-partum therapists, among others is specifically intended to target and strengthen the Transverse Abdominus, and entails having a patient assume a prone upright position on their respective hands and knees, and then contract or pull the stomach in towards the spine either for a prolonged count or for a number of repetitions. To make such exercises as productive as possible, there exists a need for an exercise device which offers resistance to contraction or pulling in of the Transverse Abdominus muscles.

SUMMARY OF THE INVENTION

It is a general object of the present invention to avoid the above-noted deficiencies of the prior art.

It is another general object of the present invention to provide an exercise apparatus that provides enhanced capability than previous devices of this type, particularly providing complete training of the Transverse Abdominus muscles.

The present invention provides an abdominal muscle exercise apparatus, which particularly offers substantial resistance to contracting or pulling in of the Transverse Abdominus muscles. The invention further provides mental focus to the exercise, as the user contracts or pulls his/her stomach in towards the spine.

Briefly stated, an apparatus for exercising the abdominal muscles, and particularly the Transverse Abdominus, includes a flexible substrate having a reusable adhesive on one side thereof to temporarily adhere the apparatus directly to a user's abdomen. A plurality of weights optionally are applied to the apparatus for increased resistance. With the user on his/her hands and knees, the apparatus adds resistance and mental focus to the exercise, as the user contracts or pulls his/her stomach in towards the spine.

An exemplary embodiment includes a substrate made from a flexible material that substantially conforms to a user's abdomen, with a substantially flat or contoured interior surface having a pressure sensitive adhesive (PSA) film thereon to adhere the apparatus to the user's abdomen. A cord or strap is fixedly attached to the opposite surface of the substrate, the cord being configured at a distal end to permit the inclusion of one or more small weights, the exemplary embodiment having a T-shape on the opposite end of the cord or strap. One or more small weights that fit on the cord (e.g., preferably doughnut-shaped weights) optionally are secured by hanging from the T-shaped end, thereby adding increased resistance to the exercise.

The exercise apparatus is adhered to a user's abdomen due to the tacky nature of the adhesive film, which optionally is inherent in the flexible material, or alternatively is applied to the substrate according to known methods, as described in further detail below.

These and other objects, features and advantages will become readily apparent from the following Detailed Description which should be read in conjunction with the accompanying drawings.

DETAILED DESCRIPTION

Figure 1:
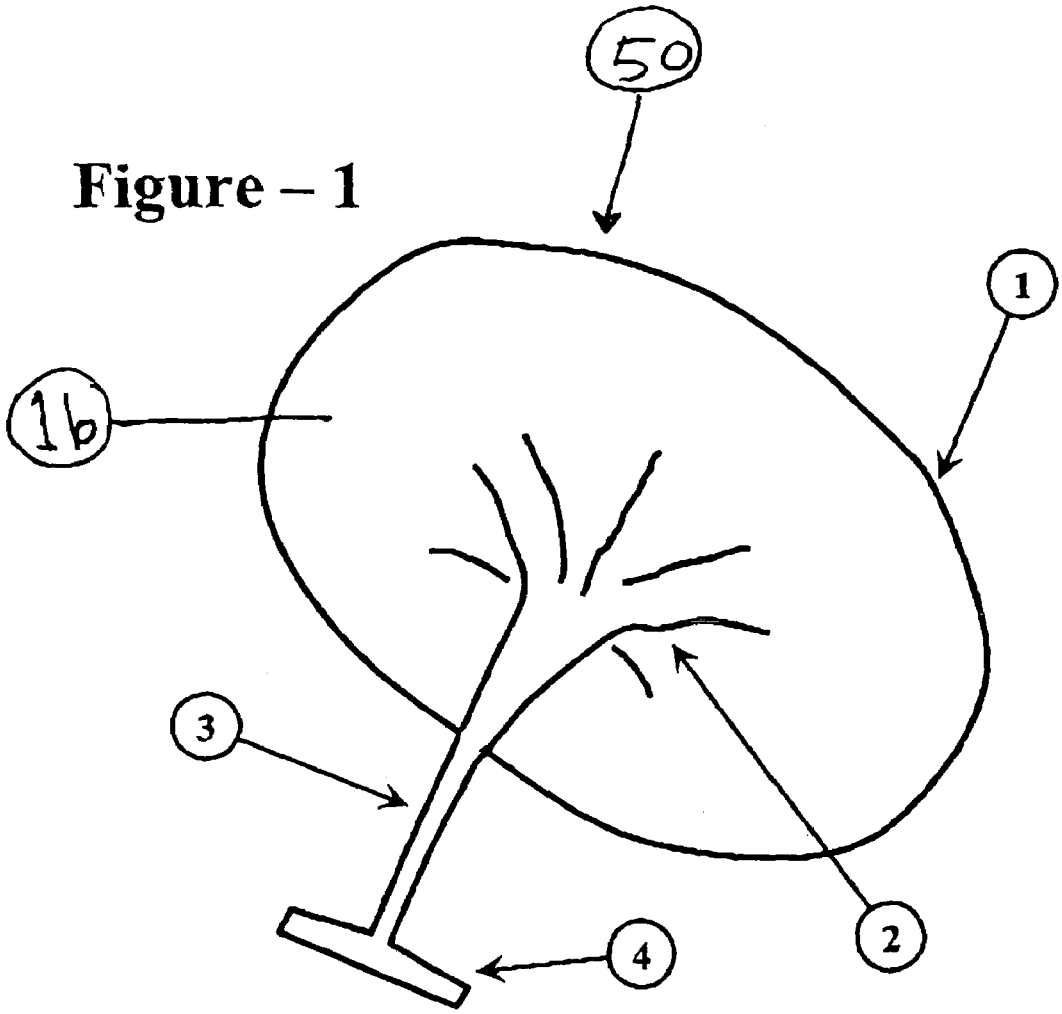
FIG. 1 is a rear isometric view of the exercise apparatus according to a first embodiment of the present invention.
Figure 2:
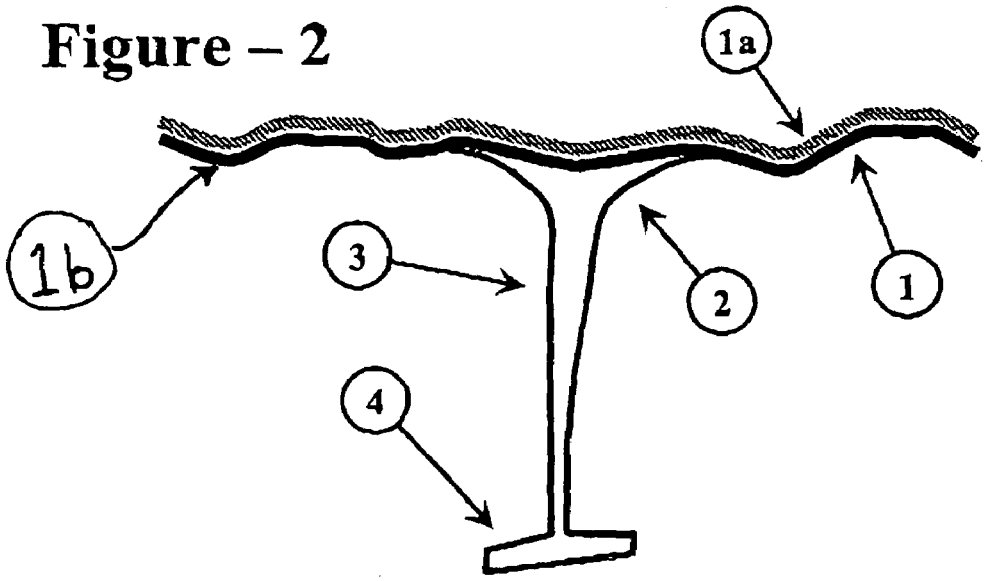
FIG. 2 is a side elevational view of the apparatus of FIG. 1.

The following description relates to certain exemplary embodiments of an exercise apparatus according to the present invention. It will be readily apparent that numerous variations and modifications other than those specifically indicated will be readily apparent to those of sufficient skill in the field. In addition, certain terms are used throughout the discussion in order to provide a convenient frame of reference with regard to the accompanying drawings, such as "top" "bottom", "interior", "distal", and the like. These terms are not intended to be specifically limiting of the invention, except where so indicated in the claims.

The invention provides a concentration aid, as well as resistance, while exercising the Transverse Abdominus muscles. In its preferred form, the apparatus is molded from a soft silicone, natural or synthetic rubber or a rubber-like material, a cloth-coated polychloroprene (Neoprene), synthetic polymers, or a durable cloth, allowing the apparatus to conform to the shape of the user's abdomen. The strap or cord optionally is manufactured as an integral part together with the substantially flat or contoured flexible substrate, or alternatively, the strap or cord is manufactured separately and affixed to the substrate, preferably at a center point thereof. The shape of the flexible substrate that contacts the user's skin is not critical, rectangular, circular, oval, oblong or irregular shapes all being suitable.

Referring now to FIGS. 1-4, a first embodiment of the present invention is shown. The exercise apparatus 50 includes a flat or contoured, flexible substrate 1 having an exterior surface 1*b* and an interior surface 1*a*, respectively. The interior surface 1*a* minimally comprises a tacky pressure sensitive adhesive (hereinafter referred to as "PSA"), such as that used in backless, strapless bras, as described in U.S. Pat. Nos. 6,758,720, 6,780,081 and 6,200,195 the contents of each being herein incorporated by reference in the entirety. Suitable adhesives include, but are not limited to, silicone gel adhesives, acrylate copolymer microshperes, and other known adhesives, including glue, single-sided and double-sided tape. The adhesive layer preferably has a minimum diameter of at least four (4) inches, which the inventor has determined is normally sufficient to allow adhesion of the exercise apparatus to the user's skin. One end of a cord 3 is attached to the exterior surface 1*b* of the substrate 1 at a center attachment point 2 using known means, such as gluing, sewing, fasteners, and/or other well known techniques, or may be formed integrally with the substrate. The cord optionally is made from a non-elastic or an elastic material. The actual method of attachment of the cord 3 to the exterior surface 1*b* of the substrate 1 is not a critical portion of the present invention, as will become readily apparent from this description. The distal or free end of the attached flexible cord 3 includes a flexible T-shaped portion 4 that permits the inclusion of optional weight plates 9, as described in greater detail below.

In one embodiment of the exercise apparatus 50, the flexible substrate 1 preferably is made of a silicone rubber, with a silicone gel adhesive layer integrally formed on the interior surface 1*a*. In this embodiment, the flat or contoured, flexible substrate 1 is shown as being at least 0.75 mm thick and the silicone gel adhesive layer on the interior surface 1*a* is preferably 1.5 to 2.5 mm thick, so that the exercise apparatus is non-bulky and comfortable when stuck to the skin. In the exercise apparatus thus obtained, the silicone gel adhesive layer is integrally formed on the silicone rubber, so that the boundary of the two materials is indistinct. If the silicone gel adhesive layer is attached to the silicone rubber only by its adhesion, the adhesive layer is liable to separate from the silicone rubber and is not suitable for repeated use. Alternatively, the pressure sensitive adhesive (PSA) layer is adjoined to a PSA supporting layer, which can be formed from a variety of different types of films or fabrics known in the art. For example, the PSA optionally is permanently grown to a thermoplastic film that comprises a portion of the interior surface 1*a* of the flexible substrate 1. The thermoplastic film material can be any type of plastic or polymer that is suitable for heat lamination, such as polyurethane or the like. It is understood that the interior surface can be formed from a number of other materials besides a thermoplastic film material. The interior surface serves as a PSA support layer. The interior surface can be formed from any type of film material or fabric material suitable for adjoining to a PSA. One suitable fabric material is an unwoven fabric, which can be substantially impervious to the PSA. Additionally, various types of woven fabrics can be made suitable for the function of supporting the PSA layer. Thus, a variety of materials and methods can used to form the interior surface of the flexible substrate and for applying the PSA layer to the interior surface thereof. The amount and type of PSA comprising the pressure sensitive adhesive layer can vary, as can the portions of the interior surface that include the PSA layer. Various factors can contribute to the amount, type, and placement of the PSA layer, such as, for example the size of the user's abdomen and the amount of hair on the user's abdomen.

The PSA preferably is a re-usable PSA that is permanently grown to the interior surface 1*a* of the flexible substrate 1. The PSA also can be applied to the interior surface by other methods, such as, for example, spray coating, hot melting, extrusion or co-extrusion application, die application, or other methods known for applying a PSA to a substrate. Unlike other known adhesives, the PSA will not readily shift, once it is positioned on the user, and can be re-used repeatedly, without losing its adhesive properties. The PSA must have an adhesion force to the flexible substrate that is greater than a cohesion force to the user's skin. The PSA is further able to withstand tremendous movement and pressure from the user, without slipping, and can even be subjected to water or sweat without degeneration of the adhesive properties. In fact, if the PSA becomes dirty (i.e., collects unwanted particles, such as dust, lint, or debris), it can be cleaned with soap and water to remove the unwanted particles and fully restore the adhesive properties. The thermoplastic film material and fabric layer can be permanently and inseparably adjoined by heat lamination or other similar processes. Alternatively, the flat or contoured interior surface is coated with a pressure sensitive adhesive (PSA) film, such as that disclosed in U.S. Pat. Nos. 3,691,140 and 6,017,624, the complete disclosures of which are hereby incorporated herein by reference in their entireties.

The tacky adhesive interior surface 1*a* includes reusable adhesive qualities that allow the apparatus to stick to the abdominal region of the user, while small weights are suspended or otherwise disposed on the T-shaped end of the flexible cord 4. The tacky adhesive surface 1*a* also allows the apparatus to be repeatably affixed to the abdomen and peeled off, without causing damage or injury to the user's skin. Although in describing the exemplary embodiments, various specific adhesive materials are described herein, any tacky, reusable adhesive material that will not harm the user's skin is suitable. Further, although in the exemplary embodiment, the adhesive is fixed to the substrate, the adhesive optionally is separate from the substrate and is added prior to exercise. For example, the adhesive optionally is provided separately and adhered to the substrate by the user, such as by providing the adhesive in the form of a two-sided sticker having a protective layer that is removed prior to adhering the adhesive to the substrate.

Figure 3:
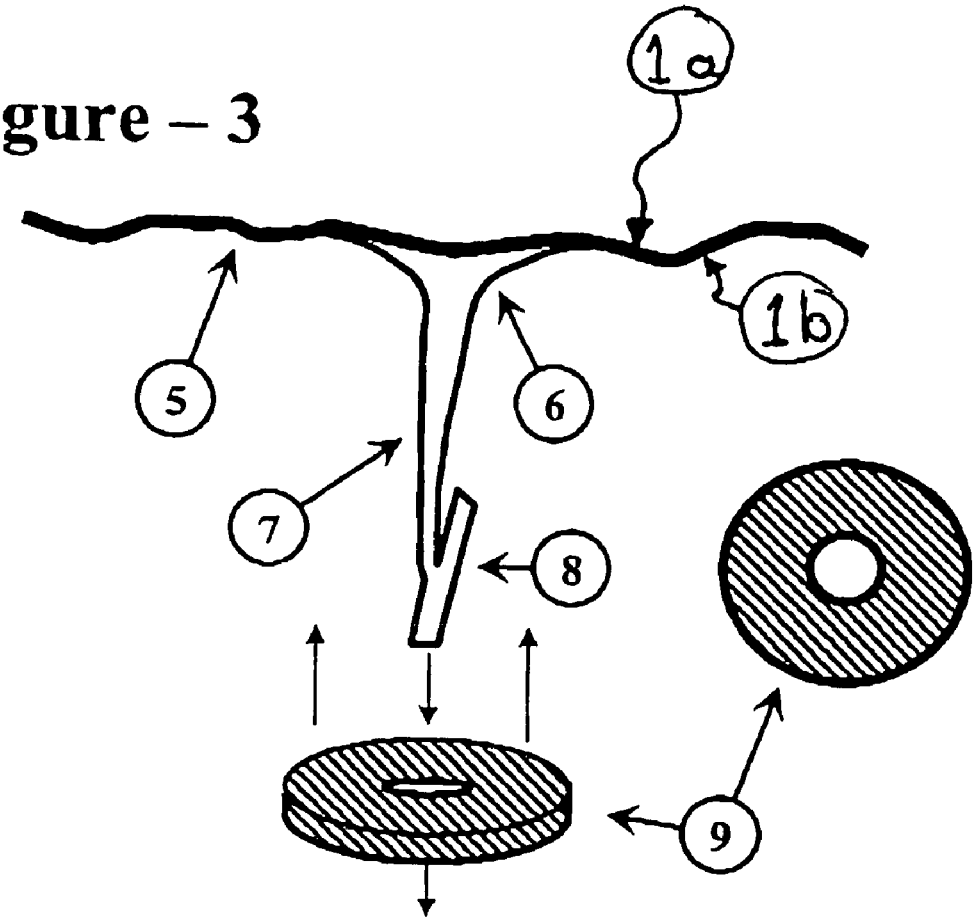
FIG. 3 is the side elevational view of the apparatus of FIGS. 1 and 2, illustrating the hanging of weights from the cord.
Figure 4:
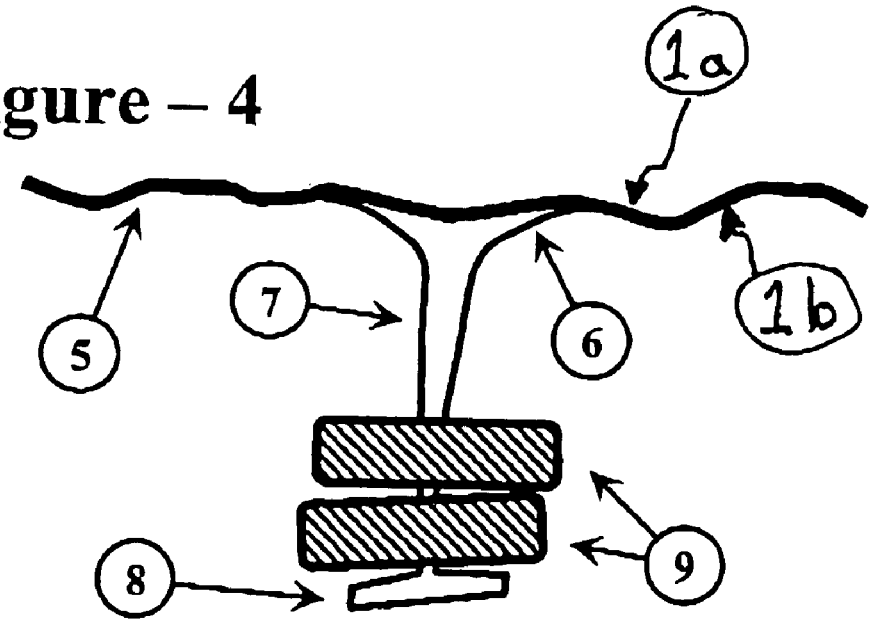
FIG. 4 is a side elevational view of the apparatus of FIGS. 1-3, with weights as attached thereto.

Referring specifically to FIG. 3, the T-shaped end 4 of the cord 3 is hingable so as to fold relatively flat, allowing a selected number of weight plates 9 to be added, as shown in FIG. 4, and secured to the cord by the T-shaped end 8, wherein each weight plate optionally is a disk-like member having parallel top and bottom surfaces, as well as a center through opening. Other weight shapes can be used, without departing from the invention.

Figure 5:
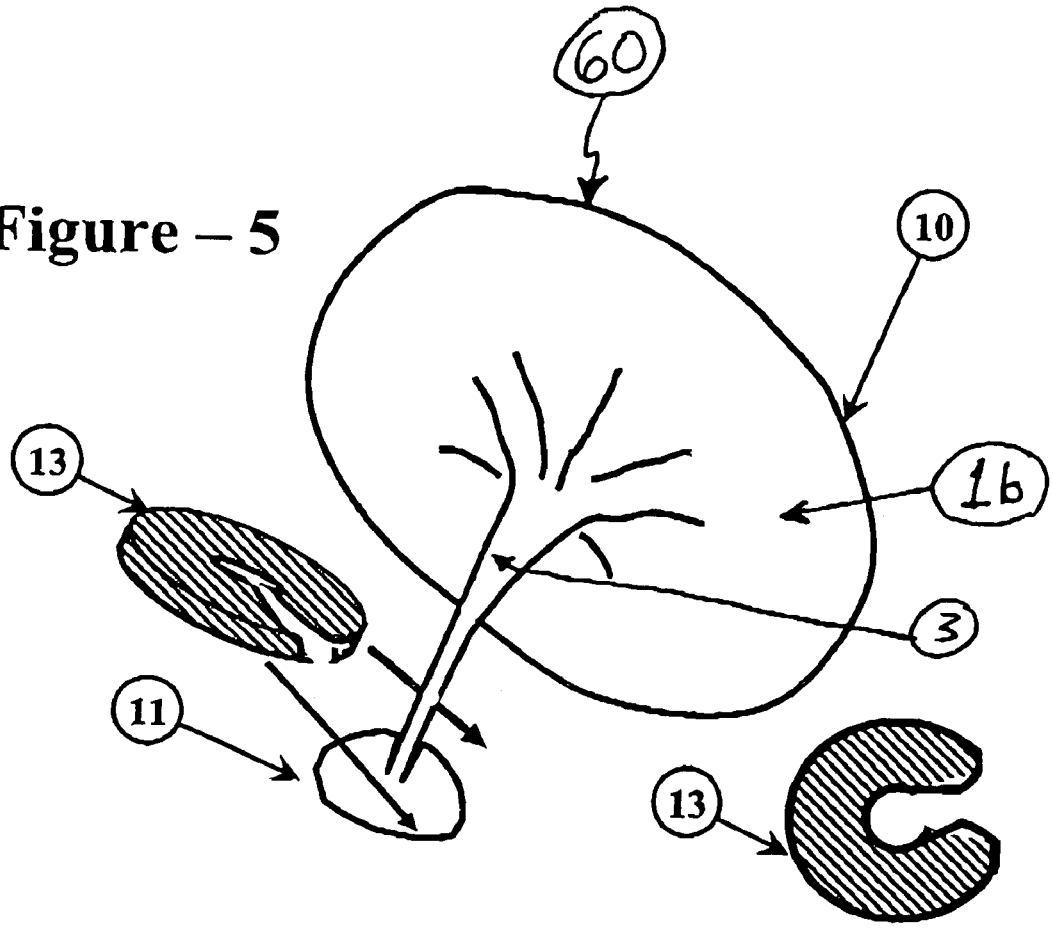
FIGS. 5 and 6 depict rear isometric views of an exercise apparatus made in accordance with a second embodiment of the present invention and in particular the use of show an embodiment wherein the T-shaped end is replaced with a flat disk.
Figure 6:
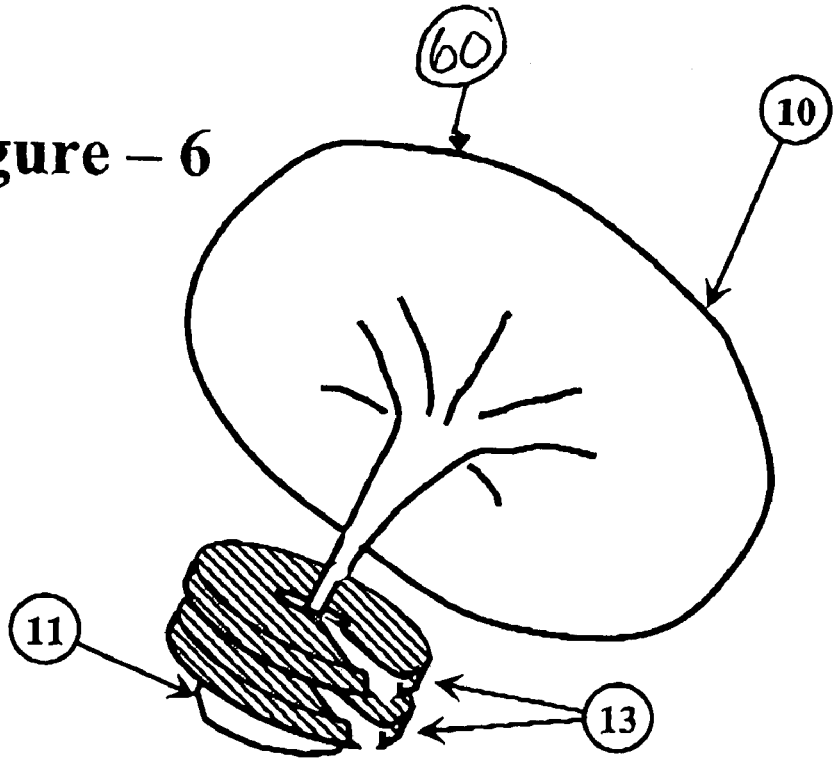

It will be readily apparent that other appropriate means can be used to suspend a plurality of weights onto the exercise apparatus. As shown in FIGS. 5 and 6, a second embodiment of an exercise apparatus 60 is shown. Similar parts are labeled with the same reference numbers for the sake of clarity. The exercise apparatus 60 includes a flexible substrate 1 as previously described, having an interior surface (not shown) that is releasably adhered to the abdomen, as well as an exterior surface 1*b* having attached thereto at a center attachment point at one end of a flexible cord 3. In lieu of the T-shaped distal portion, as described in the preceding, the free end of the cord 3 is defined by a flat disk 11, which permits a plurality of slotted weight plates 13 to be added as desired.

Figure 7:
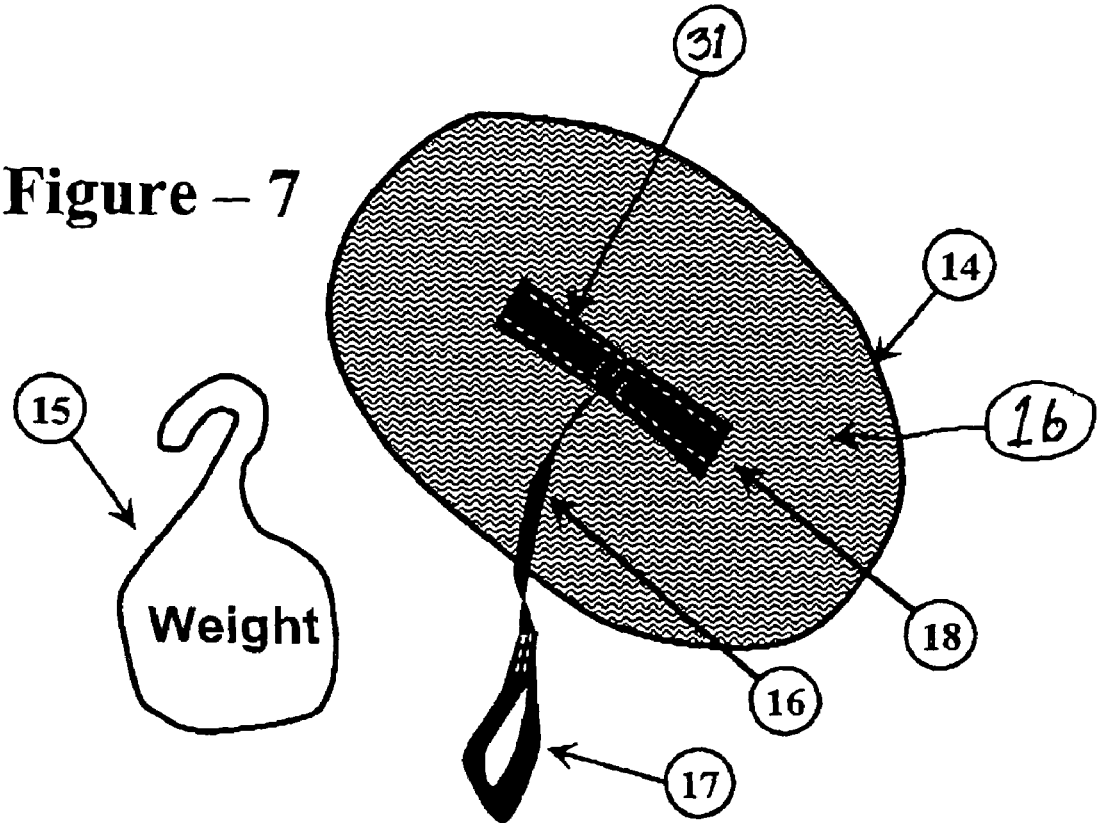
FIGS. 7 and 8 are rear isometric views of an exercise apparatus made in accordance with a third embodiment of the present invention and in particular to an embodiment wherein the flat flexible surface is made of a durable cloth-like material or rubber coated material.
Figure 8:
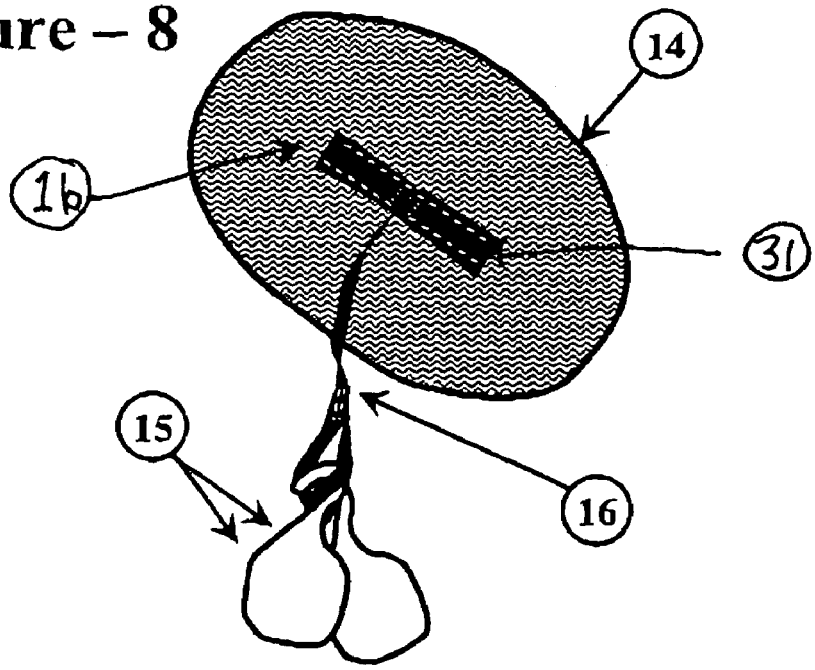

Likewise, the use of a flexible cord is not imperative to the inventive concepts of the herein described invention. FIGS. 7 and 8 illustrate a third embodiment of an exercise apparatus in accordance with the invention. As in the preceding, the parts are labeled with the same reference numbers for the sake of clarity. According to this embodiment, the exercise apparatus 70 is again defined by a flexible substrate 1, whose interior surface (not shown) is made from a tacky, adhesive that permits releasable attachment to the abdomen of a user. The substrate described is of a shape and size substantially shaped so as to contour onto the majority of a user's abdomen. In lieu of a flexible cord, as in the previous embodiments, a strap 16 is attached by conventional means to the exterior surface 1*b*, such as, for example, by way of a strip 31 of cloth or other suitable material, which is stitched or otherwise attached to the exterior surface. One end of the strap 16 is attached to the center of the strip 31 for hanging weights from the strap 16.

Figure 9:
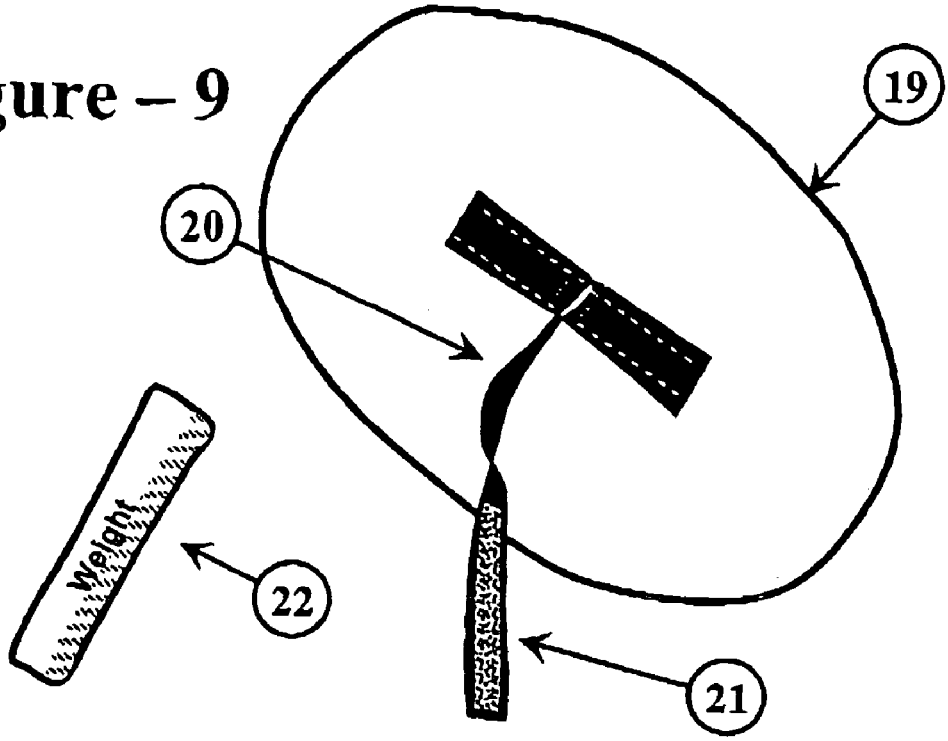
FIGS. 9 and 10 are rear isometric views of an exercise apparatus made in accordance with a fourth embodiment of the present invention in which show an embodiment wherein the flat flexible surface optionally is made of a durable cloth-like material or rubber coated material.
Figure 10:
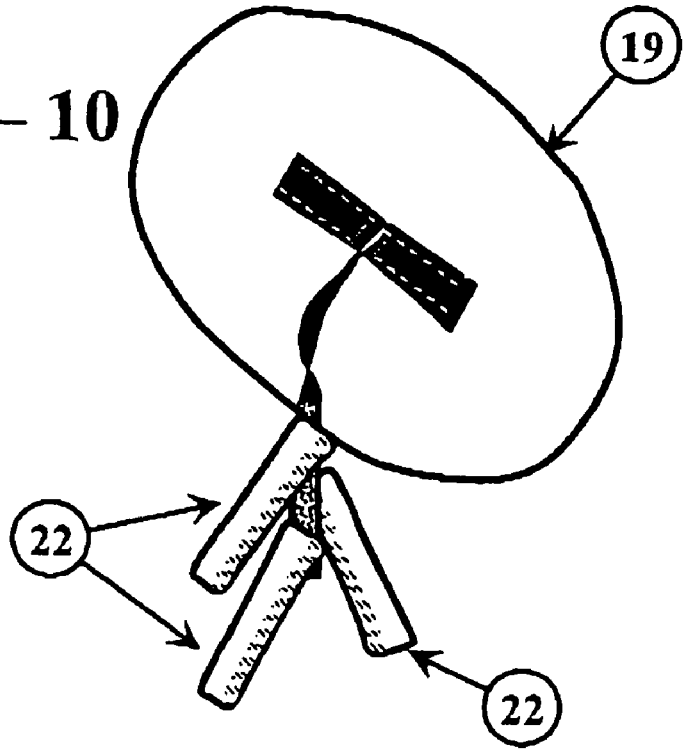

FIGS. 9 and 10 show an embodiment wherein the flat flexible surface 19 optionally is made of a durable cloth-like material or rubber coated material. A durable cloth-like strap 20 optionally is sewn or glued or otherwise attached to the flat flexible surface opposite the PSA interior side of the substrate. The strap, according to this embodiment, includes hook and loop type fastener strips 21 that are attached thereon. Cloth enclosed hook and loop type fastener weights 22 optionally are attached to the strap 20 to provide resistance.

Figure 11:
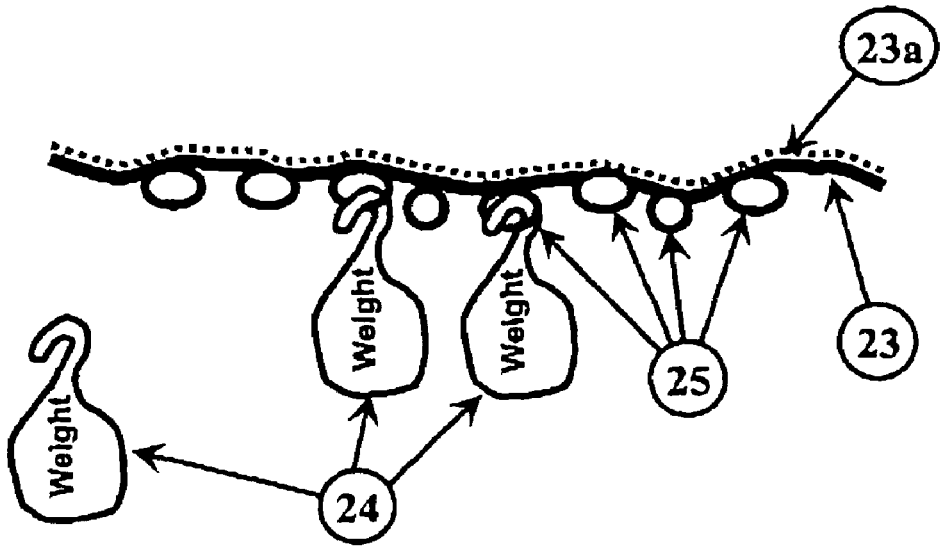
FIG. 11 is a side elevational view of an exercise apparatus made in accordance with a fifth embodiment of the present invention in which weights are selectively supported from a plurality of locations relative to the substrate shows an embodiment wherein the flat flexible surface has no strap.

In lieu of the apparatus described by the previous embodiments, FIG. 11 shows an embodiment wherein the flat flexible surface 23 has no strap. Hooked weights 24 attach directly to the flat surface 23 on the substrate by means of loops 25 that are provided on the side opposite that of the reusable pressure sensitive adhesive (PSA) 23*a*. The substrate can support the weights by a myriad of different combinations or techniques, and the weights optionally are centrally hung or distributed over the span of the substrate, to provide variations in resistance.

Figure 12:
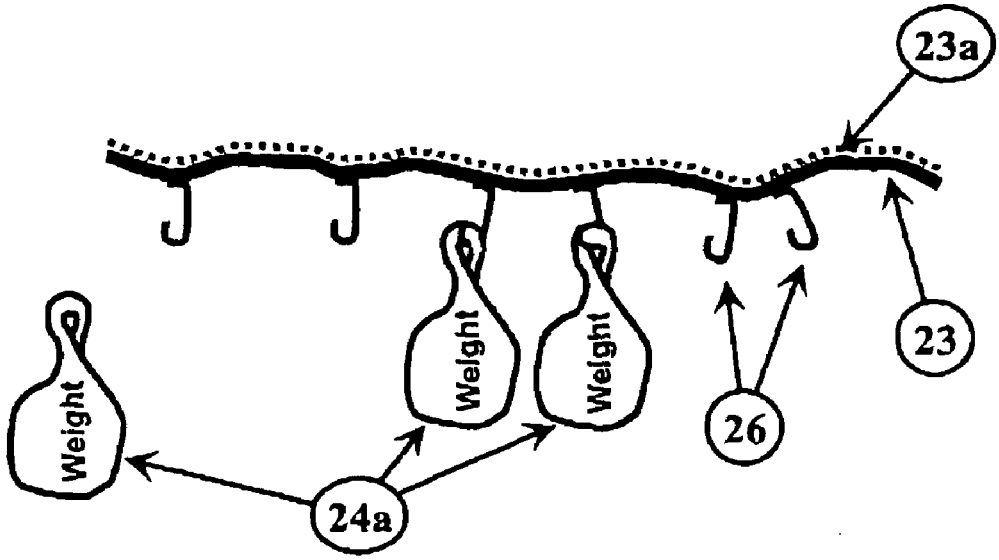
FIG. 12 is a side elevational view of an exercise apparatus made in accordance with a sixth embodiment of the present invention wherein shows an alternative embodiment wherein the flat flexible surface has no strap.

FIG. 12 shows yet another alternative embodiment to the exercise apparatus, wherein the flat flexible surface 23 has no strap. As in the preceding, a contoured, flexible substrate, shaped to conform to the abdomen of a user, includes an interior surface and an exterior surface. According to this embodiment, a plurality of hook-like members are secured to the exterior surface of the substrate, that is, the side opposite the PSA side. The hook-like members each include a base portion that is secured by conventional means, such as, for example, by riveting, stitching or other means. The hook-like members are spaced from one another, according to this embodiment, across the span of the substrate, though any other convenient configuration is suitable. An extending C-shaped end hook section is shaped to engage a corresponding set of weights. Each of the weights includes a looped portion at the top of a body thereof for fitting into a C-shaped end. Weights with loops 24*a* selectively attach directly to the flat surface 23 by hooks 26 along the exterior surface of the substrate.

In use, according to either embodiment of FIG. 11 or FIG. 12, weights can be selectively added anywhere along the span of the substrate, in order to better develop the muscles being trained, wherein the load is distributed, as opposed to being directed at a center area.

Figure 13:
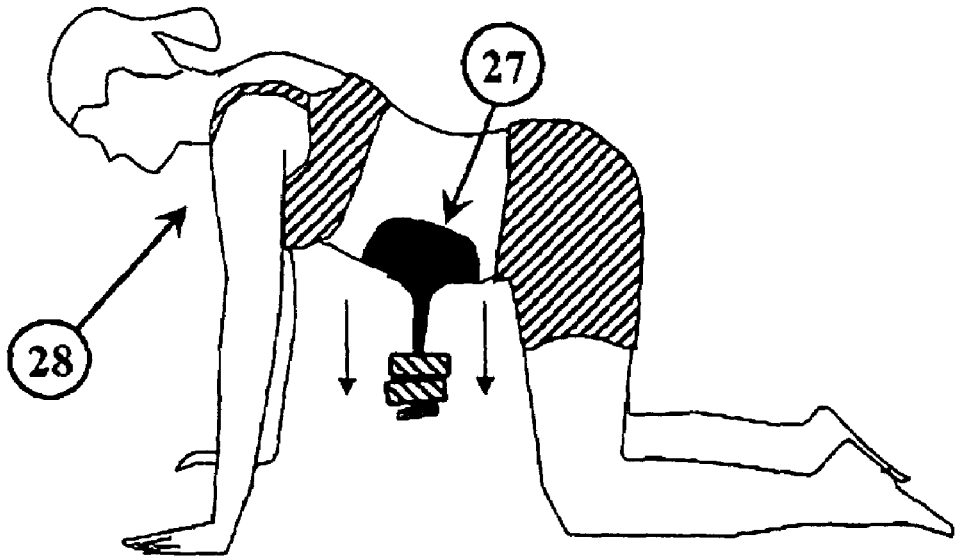
FIGS. 13 and 14 represent exemplary pictorial representations of how the exercise apparatus of the present invention is intended to be used.
Figure 14:
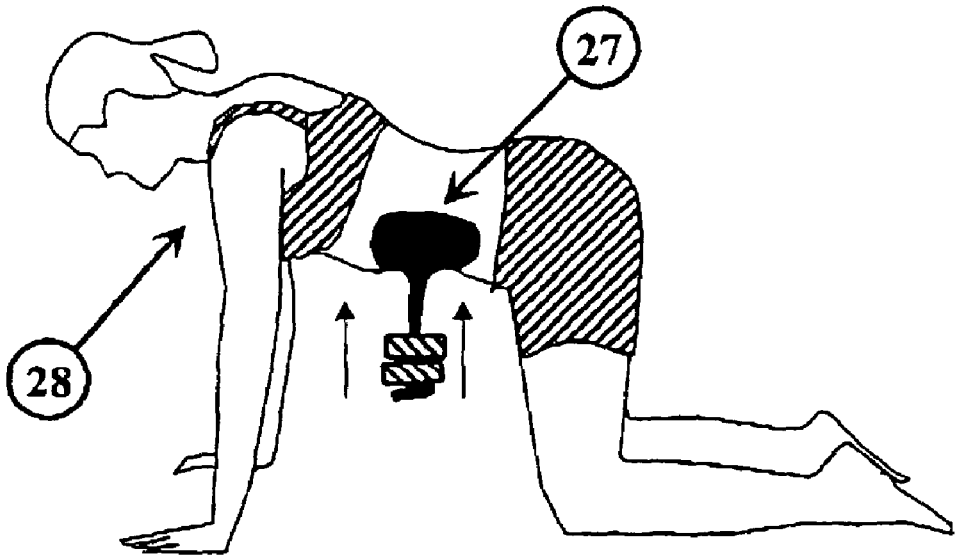

FIGS. 13 and 14 show one intended use for the exercise apparatus of the present invention is intended to be used generally. The exercise apparatus 27 attaches to the abdominal region of the user 28. The user 28 initially assumes an upright prone position in which the user is supported on his or her hands and knees. The apparatus is mounted such that the interior surface of the substrate is affixed to the stomach and the requisite number of weights are added to provide a suitable amount of resistance. The user then contracts the stomach muscles and pulls the apparatus inward towards their spine.

In typical practice, a user of the apparatus according to the present invention would get on his/her hands and knees and press the flat tacky interior surface of the substrate 1 onto the abdomen. The user then applies the desired amount of weights to the apparatus. By repeating a motion whereby the stomach is pulled inward and upward, the user strengthens the Transverse Abdominus muscles. After exercising, the apparatus can be peeled from the skin of the user, without damage to the either the apparatus or the skin. The apparatus can be washed with water and reused.

Figure 15:
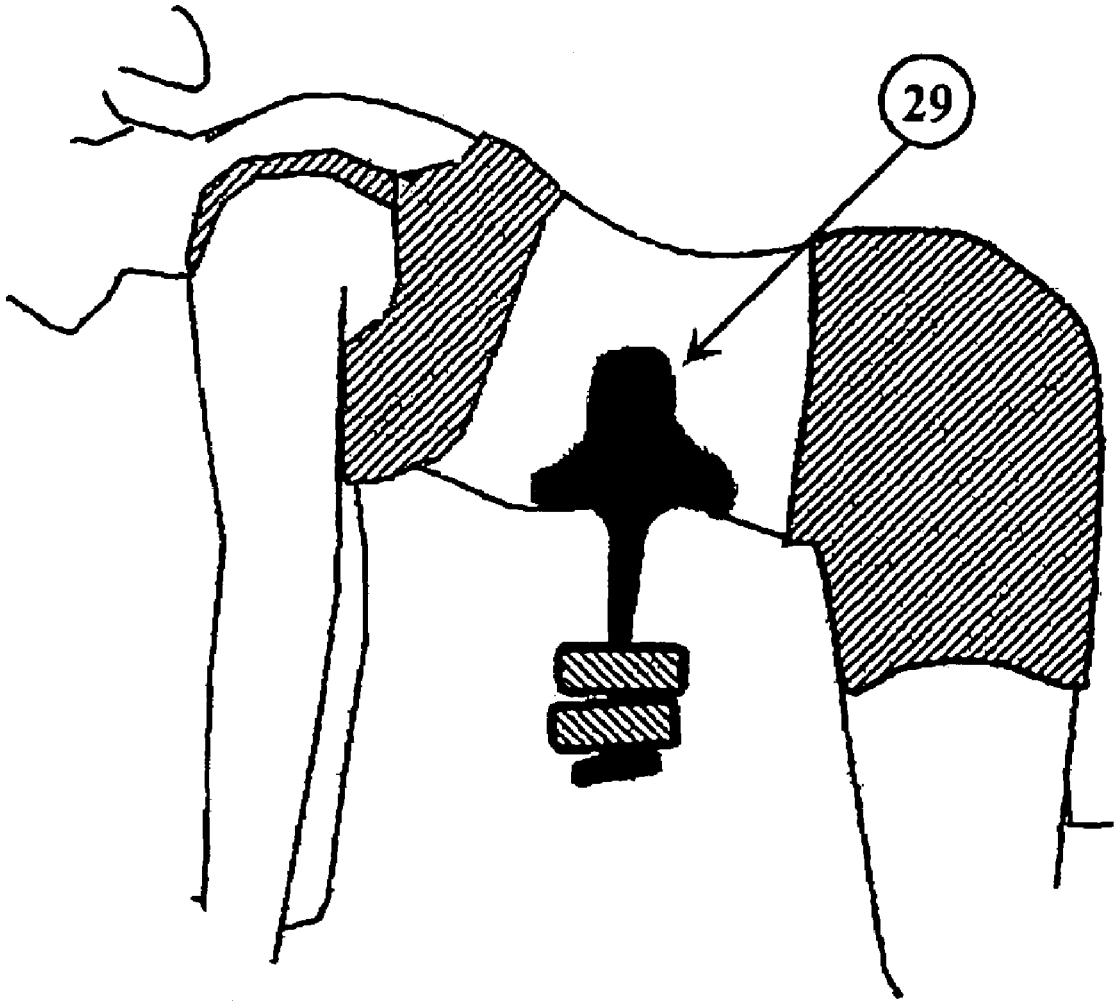
FIG. 15 represents a pictorial view of an exercise apparatus in accordance with the present invention and in particular shows an embodiment shaped to wrap part of the way around the sides of the stomach to allow for better adhesion.

A potential problem is excessive hair on the abdomen of the user of the apparatus. The presence of hair could cause a resulting loss of adhesion. A variation of the invention would include the provision of a substrate having an adhesive surface shaped or configures such that the substrate wraps around towards the lateral sides of the abdomen. This shape variation creates more surface area for adhesion and adds adhesion area to a part of the abdomen that usually has less hair. FIG. 15 shows one alternative embodiment of such an apparatus, the substrate in this instance having extension tabs 29 shaped or configured to wrap part of the way around the sides of the stomach to allow for better adhesion, such as in the instance wherein the user has abdominal hair.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method for abdominal exercise, comprising the steps of:

a) providing an apparatus for abdominal exercise having a substrate made from a flexible material that substantially conforms to a user's abdomen, means for adhering said apparatus to the skin of said user's abdomen, and having weight adding means attached to said substrate for permitting a variable amount of weight to be added to said apparatus to provide resistance;

b) adhering said exercise apparatus to the abdomen of a user thereof; and c) wherein said user of said exercise apparatus assumes prone upright position on their respective hands and knees and then contracts or pulls the stomach in towards the spine for a prolonged count or for a number of repetitions.

2. The method of claim 1, wherein said apparatus is reusable.

3. The method of claim 1, wherein said weight adding means of said apparatus includes at least one of a cord and a strap attached to a side of said substrate opposite said side having said tacky pressure-sensitive adhesive.

4. The method of claim 1, wherein said substrate is oblong or irregularly shaped to permit skin contact around to the sides of the abdomen.

5. The method of claim 3, wherein said at least one of a cord and a strap includes an end configured to receive at least one weight.

* * * * *